US005848532A

United States Patent [19]

Gamble et al.

[11] Patent Number: 5,848,532

[45] Date of Patent: Dec. 15, 1998

[54] COOLING SYSTEM FOR SUPERCONDUCTING MAGNET

[75] Inventors: Bruce B. Gamble, Wellesley; Ahmed Sidi-Yekhlef, Framingham, both of Mass.

[73] Assignee: American Superconductor Corporation, Westborough, Mass.

[21] Appl. No.: 844,991

[22] Filed: Apr. 23, 1997

[51] Int. Cl.[6] ..... F17C 3/10; F25B 19/00

[52] U.S. Cl. ..... 62/48.2; 62/51.1

[58] Field of Search ..... 62/48.2, 51.1

[56] References Cited

U.S. PATENT DOCUMENTS

| | | | |
|---|---|---|---|
| 319,434 | 6/1885 | Wren | 62/51.1 X |
| 3,492,830 | 2/1970 | Mulder | 62/51.1 |
| 3,882,687 | 5/1975 | Asztalos et al. | 62/51.1 X |
| 4,111,002 | 9/1978 | Van Mal et al. | 62/51.1 X |
| 4,242,885 | 1/1981 | Quack et al. | 62/51.1 X |
| 4,692,560 | 9/1987 | Hotta et al. | 62/51.1 X |
| 4,872,314 | 10/1989 | Asano et al. | 62/51.1 X |
| 5,193,349 | 3/1993 | Laverman et al. | 62/51.1 X |
| 5,461,873 | 10/1995 | Longsworth | 62/51.1 |
| 5,469,711 | 11/1995 | McCoy | 62/51.1 |
| 5,482,919 | 1/1996 | Joshi | 310/52 |
| 5,485,730 | 1/1996 | Herd | 62/51.1 |
| 5,513,498 | 5/1996 | Ackermann et al. | 62/51.1 |

*Primary Examiner*—Christopher B. Kilner
*Attorney, Agent, or Firm*—Fish & Richardson P.C.

[57] ABSTRACT

A cooling system is configured to control the flow of a refrigerant by controlling the rate at which the refrigerant is heated, thereby providing an efficient and reliable approach to cooling a load (e.g., magnets, rotors). The cooling system includes a conduit circuit connected to the load and within which a refrigerant circulates; a heat exchanger, connected within the conduit circuit and disposed remotely from the load; a first and a second reservoir, each connected within the conduit, each holding at least a portion of the refrigerant; a heater configured to independently heat the first and second reservoirs. In a first mode, the heater heats the first reservoir, thereby causing the refrigerant to flow from the first reservoir through the load and heat exchanger, via the conduit circuit and into the second reservoir. In a second mode, the heater heats the second reservoir to cause the refrigerant to flow from the second reservoir through the load and heat exchanger via the conduit circuit and into the first reservoir.

20 Claims, 3 Drawing Sheets

COOLING SYSTEM FOR SUPERCONDUCTING MAGNET

This invention arose in part out of research pursuant to Subcontract No. QZ001 awarded by the Department of Energy under Prime Contract No. DE-FC36-93CH10580.

BACKGROUND OF THE INVENTION

The invention relates to cooling loads including superconducting components.

Superconducting rotating machines such as motors and generators must be cooled such that the field structures of their rotors are in the superconducting state. The conventional approach to cooling rotor field coils is to immerse the rotor in a cryogenic liquid. For example, a rotor employing field coils made of high temperature superconducting materials might be immersed in liquid nitrogen. In this case, heat generated by or conducted into the rotor is absorbed by the cryogenic liquid which undergoes a phase change to the gaseous state. Consequently, the cryogenic liquid must be replenished on a continuing basis.

Another approach for cooling superconducting components is the use of a cryogenic refrigerator or cryocooler. Cryocoolers are mechanical devices operating in one of several thermodynamic cycles such as the Gifford-McMahon cycle and the Stirling cycle. Cryocoolers have found application, for example, in cooling the stationary magnets in magnetic resonance imaging systems. See, for example, M. T. G van der Laan et al., "A 12K superconducting Magnet System, Cooled via Thermal Conduction by Means of Cryocoolers", *Advances in Cryogenic Engineering*, Volume 37, Part B, (Proceedings of the 1991 Cryogenic Engineering Conference) edited by R. I/V. Fast, page 1517 and G. Walker et al., "Cryocoolers for the New High-Temperature Superconductors," *Journal of Superconductivity*, Vol. 1No.2, 1988. Good cryocooler performance depends in large part on a design optimized for the actual conditions within which the cryocooler operates. More recently cryocoolers have been adapted for operation with rotors, such as superconducting motors and generators. One approach for doing so is described in U.S. Pat. No. 5,482,919, entitled "Superconducting Rotor", issued to Joshi, assigned to the assignee of the present invention, and incorporated herein by reference.

SUMMARY OF THE INVENTION

The invention features a cooling system configured to control the flow of a refrigerant through a load, such as a superconducting magnet or rotor, by controlling the rate at which the refrigerant is heated, thereby providing an efficient and reliable approach to cooling the load. The cooling system delivers the refrigerant to the load through a heat exchanger which is connected to a cryocooler coldhead.

In a general aspect of the invention, the cooling system includes a conduit circuit connected to the load and within which a refrigerant circulates; a first and a second reservoir, each connected within the conduit, each holding at least a portion of the refrigerant; and a heater configured to independently heat the first and second reservoirs. In a first mode, the heater heats the first reservoir, thereby causing the refrigerant to flow from the first reservoir through the load and heat exchanger via the conduit circuit and into the second reservoir. In a second mode, the heater heats the second reservoir to cause the refrigerant to flow from the second reservoir through the load and heat exchanger via the conduit circuit and into the first reservoir.

In general, among many of its advantages, the cooling system provides a relatively simple and economic approach for circulating a refrigerant used to cool the load. In particular, the cooling system does not require a pump or compressor to circulate the refrigerant through the load. Eliminating the need for such a pump or compressor is advantageous because compressors generally do not operate reliably or efficiently at cryogenic temperatures. Indeed, in many conventional superconducting cooling systems, the compressor used to circulate the refrigerant through the load is required to be operated, with added expense, at room temperature. In others, an expensive and potentially unreliable cryogenic compressor is used to circulate the flow.

The cooling system is particularly advantageous for cooling superconducting loads in applications where it is a problem locating the cold head where the refrigeration is required. For example, in magnetic resonance imaging applications, the cold head is generally located remotely from the magnet so as not to interfere with the magnetic homogeneity of the magnet. Another application involves cooling a load which is in a rotating reference frame, such as a superconducting rotor in a motor. Although rotating, leak-tight non-contaminating high pressure seals have been used in these applications, the seals are expensive and require frequent maintenance. Moreover, in certain applications, secondary flows created by high centrifugal flows preclude rotating the cold head.

Embodiments of the invention may include one or more of the following features.

The cooling system includes valves which are connected within the conduit circuit for controlling the flow into and out of the reservoirs. For example, a first valve has an input coupled to the first and the second reservoirs (e.g., at their bottom ends) and an output coupled to the load. Actuating the first valve controls the source of refrigerant to the load. A second valve has an input coupled to an output of the heat exchanger and the first reservoir (e.g., at its top end). Actuating the second valve controls which of the reservoirs receives the recondensed refrigerant from the heat exchanger. A third valve has an input coupled to an input of the heat exchanger and the first and second reservoirs (e.g., at their top ends). Actuating the third valve controls which of the reservoirs is connected to a venting backup line that connects the reservoirs to the input of the condensing heat exchanger.

The heater includes a pair of heating elements, each heating element associated with a respective one of the first and second reservoirs. The cooling system includes a cold box which encloses the heat exchanger and the first and the second reservoirs. The conduit circuit is formed of vacuum insulated transfer lines.

The refrigerant used in the cooling system is selected from a group consisting of helium, neon, nitrogen, hydrogen, oxygen or mixtures thereof. Neon is an attractive choice because it has a phase transition temperature at 27° K (one atmosphere), a temperature well-suited for cryogenically cooling loads formed of high temperature superconductors.

However, the invention is equally applicable for cooling components at cryogenic temperatures higher than those required for both high and low temperature superconductors. At those cryogenic temperatures (e.g., 150°–170° K), a fluorocarbon such as a fluoroalkane may be used. The fluoroalkane may be anyone of octafluoropropane (perfluoropropane), decafluro n-butane (perfluoro n-butane), decafluoro isobutane (perfluoro isobutane), fluoroethane (e.g., between its boiling and melting points), hexafluoropropane, heptafluoropropane (e.g., 1,1,1,2,3,3,3-heptafluoropropane and 1,1,1,2,2,3,3-heptafluoropropane) and isomers and mixtures thereof.

In another aspect of the invention, the above described cooling system is used to cool a load. The method of cooling includes heating the first reservoir to cause the refrigerant to flow from the first reservoir through the load and heat exchanger via the conduit circuit and into the second reservoir, heating of the first reservoir continuing until the refrigerant is substantially depleted from the first reservoir. The second reservoir is then heated to cause the refrigerant to flow from the second reservoir through the load and heat exchanger via the conduit circuit and into the first reservoir, heating of the second reservoir continuing until the refrigerant is substantially depleted from the second reservoir.

In one embodiment, the steps of heating the first and second reservoirs are repeated in alternating manner. The method of cooling the load can be performed at a pressure level substantially equal to one atmosphere. Alternatively, the temperature of the cooling system can be changed by operating the system at a pressure level greater than one atmosphere.

Other features and advantages will become apparent from the following description and from the claims.

DESCRIPTION

Figure 1:
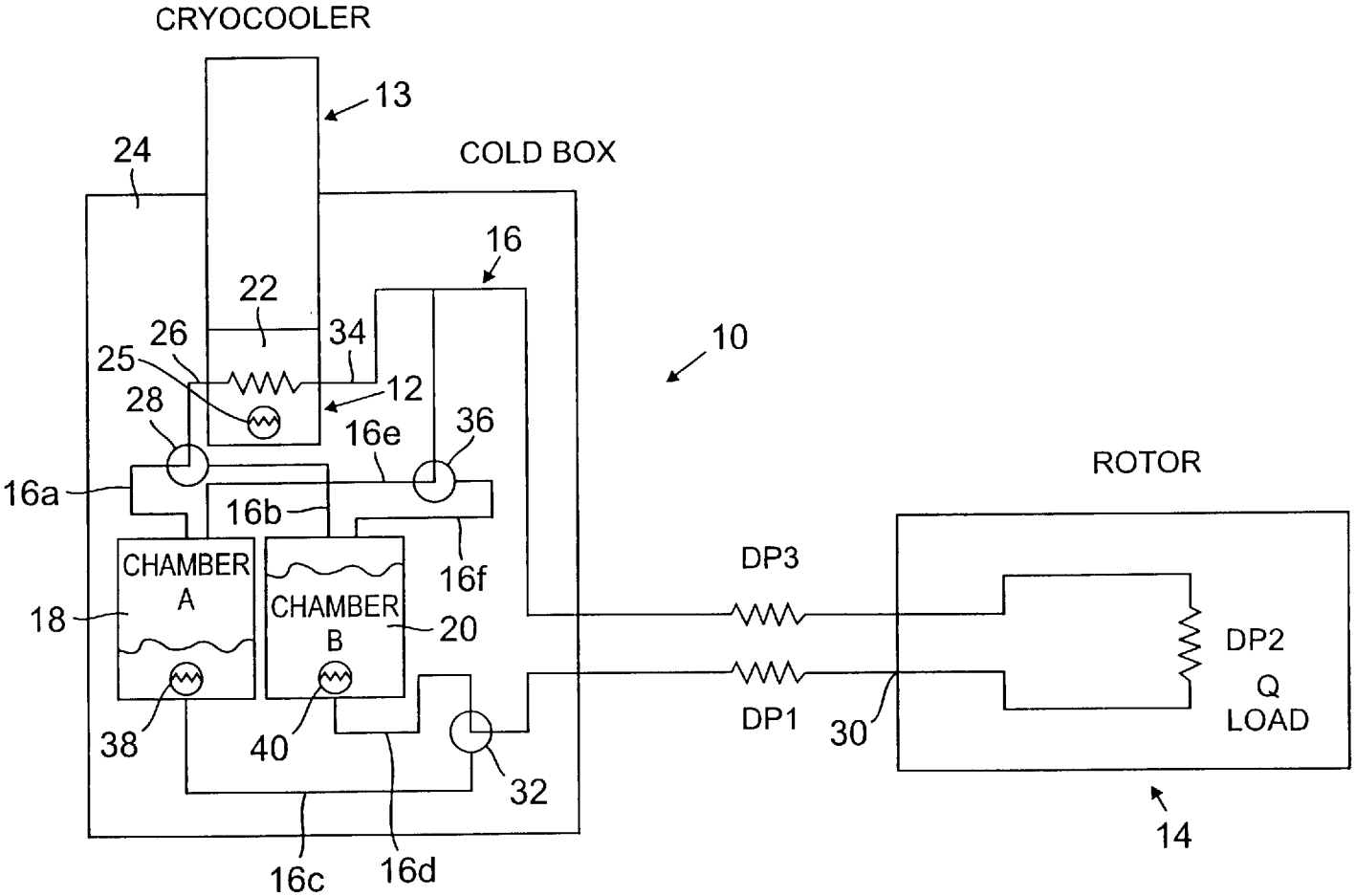
FIG. 1 is a schematic representation of a cooling system in a first mode of operation according to the invention.
Figure 2:
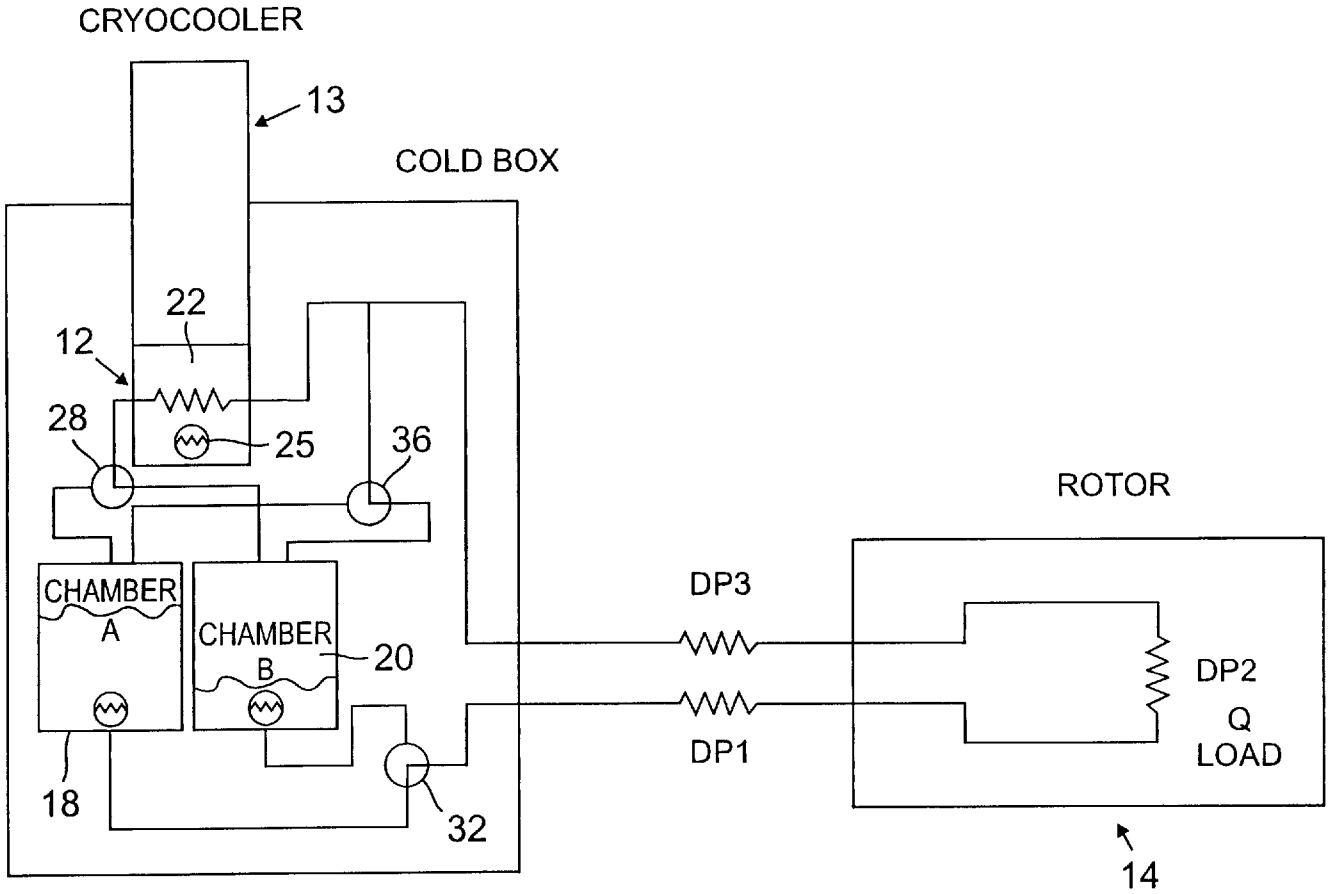
FIG. 2 is a schematic representation of the cooling system of FIG. 1 in a second mode of operation.

Referring to FIGS. 1 and 2, a cooling system 10 includes a heat exchanger 12 connected to a load 14 (e.g., a rotor of a superconducting motor) via a conduit circuit 15 through which neon refrigerant flows. The conduit circuit is formed of vacuum insulated lines 16 and represents a secondary cooling circuit (or loop) used to provide cooling from a cryocooler 13.

Figure 3:
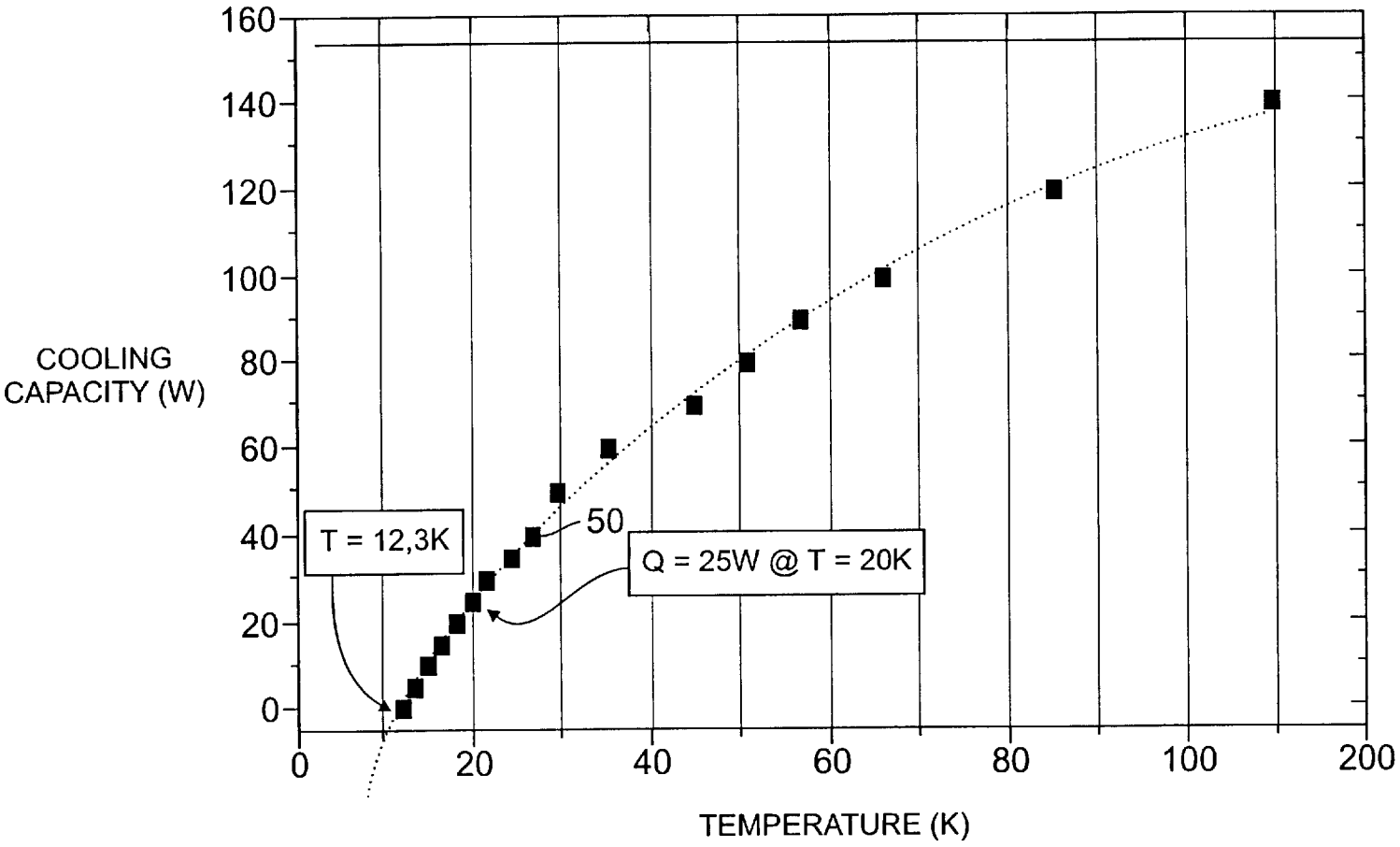
FIG. 3 is a graph indicating the cooling performance of an exemplary cryocooler used in the cooling system of FIG. 1.

Heat exchanger 12 may be in the form of any of a wide variety of configurations including perforated plate or coiled tube heat exchangers. Heat exchanger 12 is directly attached (e.g., by solder or bolting) to cryocooler 13 which is generally considered to be a part of the primary cooling circuit. Cryocooler 13 may be any of a wide variety cryocooling refrigerators designed to operate according to one of several thermodynamic cycles including Gifford-McMahon, Stirling and pulse-tube cycle, such as those described in U.S. Pat. No. 5,482,919. One example of a cryocooler appropriate for use in cooling system 10 is Model No. RGS 120-T, manufactured by Leybold, Inc., Cologne, Germany. Cryocooler 13 includes a heater 25 which, in conjunction with a temperature sensor (not shown) and feedback loop arrangement, prevents the neon refrigerant from freezing. Referring to FIG. 3, the amount of cooling power in units of watts as a function of temperature in °K is shown. This performance curve indicates that cryocooler 13 is capable of producing greater than 40 watts of cooling power at 27° K (point 50) which, for reasons discussed below, is the temperature most appropriate for cooling with a neon refrigerant a load formed of high temperature superconductor (HTS).

Cooling system 10 also includes a pair of reservoirs (e.g., storage chambers) 18, 20, each connected to heat exchanger 12 which is attached to the cold head end 22 of cryocooler 13. Reservoirs 18, 20 and cold head end 22 are enclosed within a cold box 24 having a blanket of thermal insulation or a vacuum shield (not shown) surrounding the components.

A pair of heaters 38, 40 (e.g., nichrome wire heaters) are positioned to apply heat to respective, bottom ends of reservoirs 18, 20. Reservoirs 18, 20 are each connected, at their top ends, to an output 26 of cold head end 22 through an input valve 28 via lines 16*a*, 16*b*, respectively. The bottom ends of reservoirs 18, 20 are connected to an input 30 of load 14 through an output valve 32, via lines 16*c*, 16*d*, respectively.

Reservoirs 18, 20 are also connected, at their top ends, to an input 34 of heat exchanger 12 through a venting valve 36 via lines 16*e*, 16*f*, respectively. As will be discussed below, lines 16*e*, 16*f* provide venting paths which ensure a constant and steady flow of the neon refrigerant from output 26 of cold head 22 into the reservoirs.

Valves 28, 32, 36 may be any of a wide variety of valves capable of operating at cryogenic temperatures including control or solenoidal valves. Valcor Scientific, Inc., Springfield, N.J. provides valves (e.g., on/off type) which are appropriate for use as valve 28, 32 or 36 in cooling system 10.

Referring to FIG. 1, in operation, cooling system 10 is shown in a first mode of operation with valve 28 actuated to connect output 26 of heat exchanger 12 to the input of reservoir 18 rather than to reservoir 20. Valve 32 is actuated so that load 14 receives flow of neon refrigerant from the output of reservoir 20 rather than reservoir 18. In other words, valves 28, 32 are actuated so that reservoir 20 serves as a neon refrigerant source to load 14 and reservoir 18 serves as a depository for the re-condensed refrigerant returned from load 14. Valve 36 is also actuated to connect reservoir 18 to input 34 of heat exchanger 12 and disconnect reservoir 20 from the cryocooler.

Heater 40 is then activated to apply a small amount of heat to reservoir 20 causing a relatively small amount of the liquid neon refrigerant in reservoir 20 to boil. The phase change increases the pressure in reservoir 20, thereby generating a force which causes the neon refrigerant in a liquid state to flow to load 14. The liquid neon refrigerant flows through load 14 where it undergoes a phase transition to the vapor state before travelling to input 34 of heat exchanger 12. The vapor neon refrigerant is recondensed into its liquid state at heat exchanger 12 and is passed into reservoir 18 through valve 28. When the neon refrigerant in reservoir 20 is substantially depleted, heater 40 is shut off ending the first mode of operation.

Referring to FIG. 2, in the second mode of operation, valves 28, 32, and 36 are actuated so that reservoir 18 (which was filled during the first mode of operation) serves as the neon refrigerant source to load 14 and reservoir 20 (which was emptied during the first mode of operation) serves as the depository for the re-condensed refrigerant returned from load 14. Valve 36 is also actuated to connect reservoir 20 to input 34 of heat exchanger 12 and disconnect reservoir 18 from the heat exchanger.

In the second mode of operation, heater 40 (associated with reservoir 20) is turned off and heater 38 (associated with reservoir 18) is activated to cause a small amount of neon refrigerant in reservoir 18 to boil, thereby causing the liquid neon refrigerant to flow through load 14. When the neon refrigerant in reservoir 18 is substantially depleted, heater 38 is shut off ending the second mode of operation and the cycle is repeated.

Other embodiments are within the scope of the claims. For example, although neon was used as the refrigerant in the above description of cooling system 10, other working fluids, such as helium, nitrogen, oxygen and mixtures thereof may be used depending upon the particular application, temperature of operation, and the desired level of cooling.

Neon, however, is particularly advantageous for cooling system 10 because it has a phase change from liquid to gas occurring at 27° K (one atmosphere) which is a temperature well suited for cooling superconducting components (e.g., magnets, rotors) fabricated from HTS materials, such as those described in U.S. Pat. No. 5,581,220, issued to Rodenbush et al., assigned to the assignee of the present invention and incorporated herein by reference. Thus, neon can be used to provide constant temperature refrigeration at 27° K.

Another reason why neon is well-suited as a refrigerant in cooling system 10 relates to the ratio of its density as a liquid and density as a vapor. Referring to K. D. Timmerhaus et al., Cryogenic Process Engineering, Plenum Press (1989), the densities of neon at 27° K (at one atmosphere) for liquid and gas is 1206 and 9.367 kg/m$^3$, respectively, the ratio being 130. Thus, boiling 1 cm$^3$ of liquid neon creates 130 cm$^3$ of equivalent vapor. Put another way, only 1 cm$^3$ is boiled out of 130 cm$^3$ to provide a displacing function.

The concept of the invention is equally applicable for cooling components at temperatures higher than those required for both high and low temperature superconductors. For example, cooling system 10 can also be used to cool cryogenic electronic systems at temperatures between 90° and 236° K (preferably, 150°–170° K). Examples of cryogenic electronic systems are described in U.S. Pat. No. 5,612,615, issued to Gold et al., assigned to the assignee of the present invention and incorporated herein by reference. In such cryogenic applications, refrigerants other than those described above may be preferable. For example, a fluoroalkane, or other fluorocarbon may be used, such as those described in co-pending application U.S. Ser. No. 08/698,806, entitled "Methods And Apparatus For Cooling Systems For Cryogenic Power Conversion Electronics", assigned to the assignee of the present invention and incorporated by reference.

In high voltage applications, the refrigerant used for providing refrigeration is desired to have a high dielectric strength characteristic. The above described fluoroalkanes, for example, are known to have such a characteristic.

In the above embodiment, cooling system 10 was operated at a pressure of one atmosphere; thus, providing a 27° K refrigerator. However, in certain applications, it may be desirable to operate at a different pressure, thereby changing the temperature of the cooling system. For example, the operating pressure of the system could be increased to provide a 30° K cooling system.

What is claimed is:

1. A cooling system for circulating a refrigerant flowing through a heat exchanger which is connected to a cryocooler coldhead, the cooling system delivering the refrigerant to a load and comprising:

a conduit circuit connected to the load and within which the refrigerant circulates;

a first and a second reservoir, each connected within the conduit, each holding at least a portion of the refrigerant;

a heater configured to independently heat the first and second reservoirs, the heater operating, in a first mode, to heat the first reservoir, thereby causing the refrigerant to flow from the first reservoir through the load and heat exchanger via the conduit circuit and into the second reservoir, and operating, in a second mode, to heat the second reservoir to cause the refrigerant to flow from the second reservoir through the load and heat exchanger via the conduit circuit and into the first reservoir.

2. The system of claim 1 further comprising a first valve connected within the conduit circuit, the first valve having an input coupled to the first and the second reservoirs and an output coupled to the load.

3. The system of claim 2 further comprising a second valve connected within the conduit circuit, the second valve having an input coupled to an output of the heat exchanger and first reservoir.

4. The system of claim 3 further comprising a third valve connected within the conduit circuit, the third valve having an input coupled to an input of the heat exchanger and the first and second reservoirs, and the conduit circuit includes a venting backup line coupled between the heat exchanger, the third valve and the first and second reservoirs.

5. The system of claim 1 wherein the heater comprises a pair of heating elements, each heating element associated with a respective one of the first and second reservoirs.

6. The system of claim 1 further comprising a cold box which encloses the heat exchanger and the first and the second reservoirs.

7. The system of claim 1 wherein the conduit circuit includes vacuum insulated transfer lines.

8. The system of claim 1 wherein the load is a rotor of a superconducting motor.

9. The system of claim 1 wherein the refrigerant is selected from a group consisting of helium, neon, nitrogen, hydrogen, oxygen and mixtures thereof.

10. The system of claim 8 wherein the refrigerant is neon.

11. The system of claim 1 wherein the refrigerant is a fluorocarbon liquid cryogen.

12. The system of claim 11 wherein the liquid cryogen is a fluoroalkane.

13. A method of cooling a load with a system having a heat exchanger coupled to a cryocooler coldhead and the load via a conduit circuit having a refrigerant circulating therethrough, the method comprising:

a) providing a first and a second reservoir, each connected within the conduit, each holding at least a portion of the refrigerant;

b) heating the first reservoir to cause the refrigerant to flow from the first reservoir through the load and heat exchanger via the conduit circuit and into the second reservoir, said heating of the first reservoir continuing until the refrigerant is substantially depleted from the first reservoir; and c) heating the second reservoir to cause the refrigerant to flow from the second reservoir through the load and heat exchanger via the conduit circuit and into the first reservoir, said heating of the second reservoir continuing until the refrigerant is substantially depleted from the second reservoir.

14. The method of claim 13 further comprising repeating steps b) and c) in alternating manner.

15. The method of claim 13 wherein the system further comprises a first valve and a second valve connected within the conduit circuit, the first valve having an input coupled to the first and the second reservoirs and an output coupled to the load, the second valve having an input coupled to an output of the heat exchanger and first reservoir, the method further comprising:

prior to step b), actuating the first valve to allow the refrigerant to flow from the first reservoir to the load and actuating the second valve to allow the refrigerant to flow into the second reservoir from the load; and prior to step c), actuating the first valve to allow the refrigerant to flow from the second reservoir to the load and actuating the second valve to allow the refrigerant to flow into the first reservoir from the load.

16. The method of claim 15 wherein the system further comprises a third valve connected within the conduit circuit, the third valve having an input coupled to an input of the heat exchanger and the first and second reservoirs, and the conduit circuit includes a venting backup line coupled between the third valve and the first reservoir and second reservoirs, the method comprising:

prior to step b), actuating the third valve to allow the refrigerant to flow from the first reservoir to the load; and prior to step c), actuating the third valve to allow the refrigerant to flow from the second reservoir to the load.

17. The method of claim 13 wherein the refrigerant is selected from a group consisting of helium, neon, nitrogen, hydrogen, oxygen, a fluorocarbon and mixtures thereof.

18. The method of claim 13 further comprising performing steps a), b) and c) at a pressure level substantially equal to one atmosphere.

19. The method of claim 13 further comprising performing steps a), b) and c) at a pressure level exceeding one atmosphere.

20. A system for cooling a load to cryogenic temperatures comprising:

a conduit circuit, connected to the superconducting load and within which a refrigerant circulates;

a heat exchanger, connected within the conduit circuit and to a cryocooler coldhead, the heat exchanger disposed remotely from the load;

a first and a second reservoir, each connected within the conduit, each holding at least a portion of the refrigerant;

a heater configured to independently heat the first and second reservoirs, the heater operating, in a first mode, to heat the first reservoir, thereby causing the refrigerant to flow from the first reservoir through the superconducting load and heat exchanger via the conduit circuit and into the second reservoir, and operating, in a second mode, to heat the second reservoir to cause the refrigerant to flow from the second reservoir through the superconducting load and heat exchanger via the conduit circuit and into the first reservoir.

* * * * *